United States Patent [19]

Ingenieur

[11] 4,050,233

[45] Sept. 27, 1977

[54] STEPPING MECHANISM FOR WATCHES

[75] Inventor: Kurt Murrle Ingenieur, Pforzheim, Germany

[73] Assignee: Pforzheimer Uhren-Rohwerke Rudolf Wehner, Pforzheim, Germany

[21] Appl. No.: 709,399

[22] Filed: July 28, 1976

[30] Foreign Application Priority Data

Sept. 27, 1975 Germany ..... 2543177

[51] Int. Cl.[2] ..... G04B 19/24

[52] U.S. Cl. ..... 58/58; 58/125 B; 58/126 A; 58/59

[58] Field of Search ..... 58/5, 7, 58, 125 B, 58/126 A, 59, 62

[56] References Cited

U.S. PATENT DOCUMENTS

| | | | |
|---|---|---|---|
| 3,738,097 | 6/1973 | Vuillenmier | 58/5 |
| 3,878,674 | 4/1975 | Muerrle | 58/58 X |

*Primary Examiner*—Ulysses Weldon

[57] ABSTRACT

In a watch having a rotatably mounted date ring, a date-stepping mechanism for advancing the date ring comprises a stationary peripheral first series of teeth, a rotary drive element, a date-stepping finger, which is mounted to be rotatable and radially displaceable relative to said rotary drive element into and out of engagement with said first series of teeth and comprises a stepping pin, a forked end portion having first and second prongs, and a drive pin carried by said first prong. The date-stepping mechanism also comprises a one-way coupling element, which is in one-way coupling engagement with said drive pin and is eccentric with respect to and arranged to revolve with said rotary drive element in a predetermined direction of revolution and to repeatedly withdraw said date-stepping finger from said first series of teeth after respective intervals of time, and spring means engaging said second prong and urging said date-stepping finger radially outwardly and in said predetermined direction of revolution. Said spring means are adapted to impart a rotary stepping movement to said date-stepping finger in said predetermind direction of revolution and into engagement with said first series of teeth when said date-stepping finger has thus been withdrawn from said first series of teeth. The date-stepping mechanism also comprises a second series of teeth, which are carried by the date ring and arranged to be engaged by said stepping pin during said rotary stepping movement of said date-stepping finger.

13 Claims, 5 Drawing Figures

11
12
7
3
6
5b
5a
14
1
8
4b
10
2
9
2
13
4a
4
14

20
11
18
19
22
15
7
12
22
21
5a
6
3
5b
17a
16
17c
17
10
8
9
2
4b
17b
4
1
4a

STEPPING MECHANISM FOR WATCHES

This invention relates to a stepping mechanism for watches comprising means for indicating the date and, if desired, means for indicating the day of the week, which mechanism comprises a stepping finger, which cooperates with a series of teeth.

U.S. Pat. No. 3,878,674 relates to a timepiece having a rotary drive element and indicating means and discloses a stepping mechanism for advancing said indicating means. Said stepping mechanism comprises a stationary peripheral series of teeth, a stepping finger, which is mounted to be rotatable and radially displaceable relative to said rotary drive element and engageable with said series of teeth and adapted to rotate said digital indicating means, a one-way coupling element, which is eccentric with respect to and operatively connected to said rotary drive element to revolve around the same in a predetermined direction of revolution and arranged to repeatedly withdraw said stepping finger from said series of teeth after respective intervals of time, and spring means urging said stepping finger radially outwardly and in said predetermined direction of revolution, whereby said spring means are arranged to impart a rotary stepping movement to said stepping fingers and indicating means in said predetermined direction of revolution when said stepping finger has thus been withdrawn and until said stepping finger re-engages said series of teeth.

The stepping mechanism disclosed in U.S. Pat. No. 3,878,674 can be used particularly to operate the hour-indicating means of watches but may also be used to operate date-indicating means.

It is an object of the present invention to provide stepping mechanism, which is of the general type disclosed in U.S. Pat. No. 3,878,674 and in a watch comprising means for indicating the date and, if desired, means for indicating the day of the week is used to operate such date-indicating means and any day-indicating means.

It is another object of the invention to provide a stepping mechanism which comprises movable elements that are small in relation to the indicating means to be operated thereby.

In a stepping mechanism which is of the general type disclosed in U.S. Pat. No. 3,878,674 the first object set forth hereinbefore is accomplished in that said indicating means comprise a date ring formed with a series of teeth said stepping finger is a date-stepping finger, which has a forked end portion comprising two prongs, one of which carries a drive pin, which extends through the apertured oneway coupling element, the other prong bears on a spring, which is preferably U-shaped, and said date-stepping finger carries a stepping pin which is arranged to engage with said series of teeth of said date ring and to advance the same when said date-stepping finger has thus been withdrawn from said stationary series of teeth and is moved by said spring means in said predetermined direction of revolution.

The stationary peripheral series of teeth comprise first and second teeth, which are peripherally spaced. The date-stepping finger engages the first tooth before the stepping movement, which is initiated in that the date-stepping finger is withdrawn from the first tooth and is terminated in that the date-stepping finger engages the second tooth. The first tooth is preferably provided with a hump, which protrudes radially inwardly from the date ring so that the date-stepping finger which has been withdrawn from the first tooth is clear of the date ring until the stepping finger engages the second tooth.

In a stepping mechanism in which the stationary peripheral series of teeth consist of said first and second teeth, the second object set forth hereinbefore can be accomplished if the rotary drive element is eccentric to an indicating ring carrying a second series of teeth, the one-way coupling element is arranged to repeatedly withdraw said stepping finger from said first tooth after respective intervals of time, and subsequently from said second tooth, said spring means are arranged to impart a rotary stepping movement to said stepping finger in said predetermined direction of revolution and into engagement with said second tooth when said stepping finger has thus been withdrawn from said first tooth, and said second series of teeth are arranged to be engaged by said stepping pin during its said rotary stepping movement. After the stepping finger has performed its said rotary stepping movement, the one-way coupling element withdraws the stepping finger from the second tooth, and the rotary drive element then imparts to said stepping finger a continued rotary movement in said predetermined direction of revolution until said stepping finger re-engages said first tooth under the action of said spring means. The second series of teeth are arranged to be clear of said stepping pin during said continued rotary movement of said stepping finger.

According to a further feature of the invention, the stepping mechanism is used to operate means for indicating the date and means for indicating the day of the week. In such an arrangement, a daystepping finger is provided, the date-stepping finger and the day-stepping fingers are mounted for rotation on a common axis, the day-stepping finger is formed with a slot, and the stepping pin of the date-stepping finger extends through said slot and is adapted to transmit a movement in said predetermined direction of revolution from said date-stepping finger to said day stepping finger.

The day-stepping finger may be W-shaped and comprise a spring limb and a stepping limb and be rotatably mounted between said limbs. The stepping limb interengages with a day-stepping gear for operating the day-indicating means. If the day-indicating means comprise a disc which bears the names of the days of the week in two or more languages, the stepping limb of the day-stepping finger may be arranged to step the day-stepping wheel by a plurality of tooth pitches so that the day-indicating disc can be preset to present the names of the days of the week in the desired language.

Further details of the stepping mechanism provided by the invention for the operation of date- and day-indicating means will be explained with reference to two embodiments which are shown by way of example on the drawing and will be described hereinafter.

Figure 1:
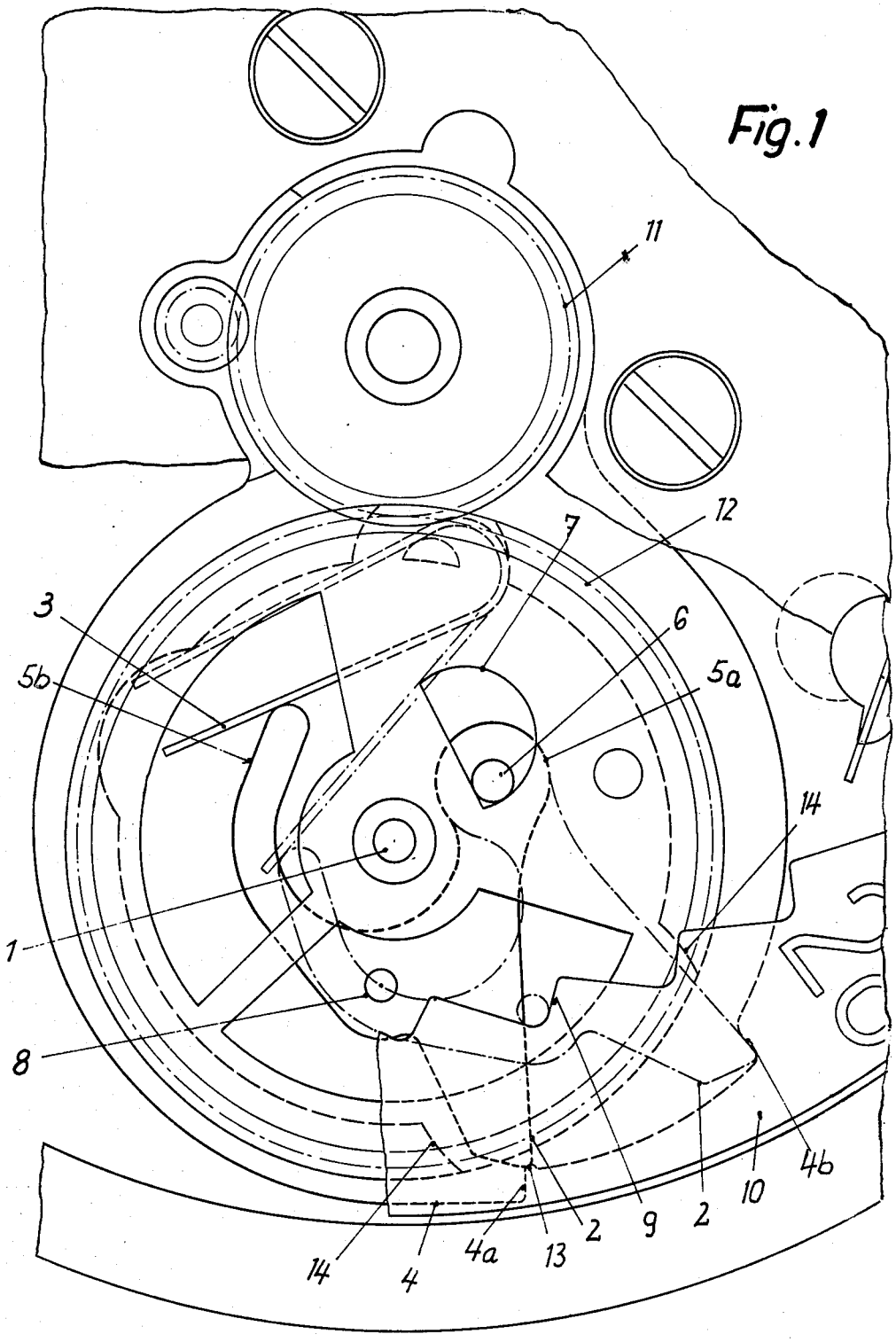
FIGS. 1 and 2 are top plan views showing a date-stepping mechanism during and before the date-stepping movement, respectively.
Figure 2:
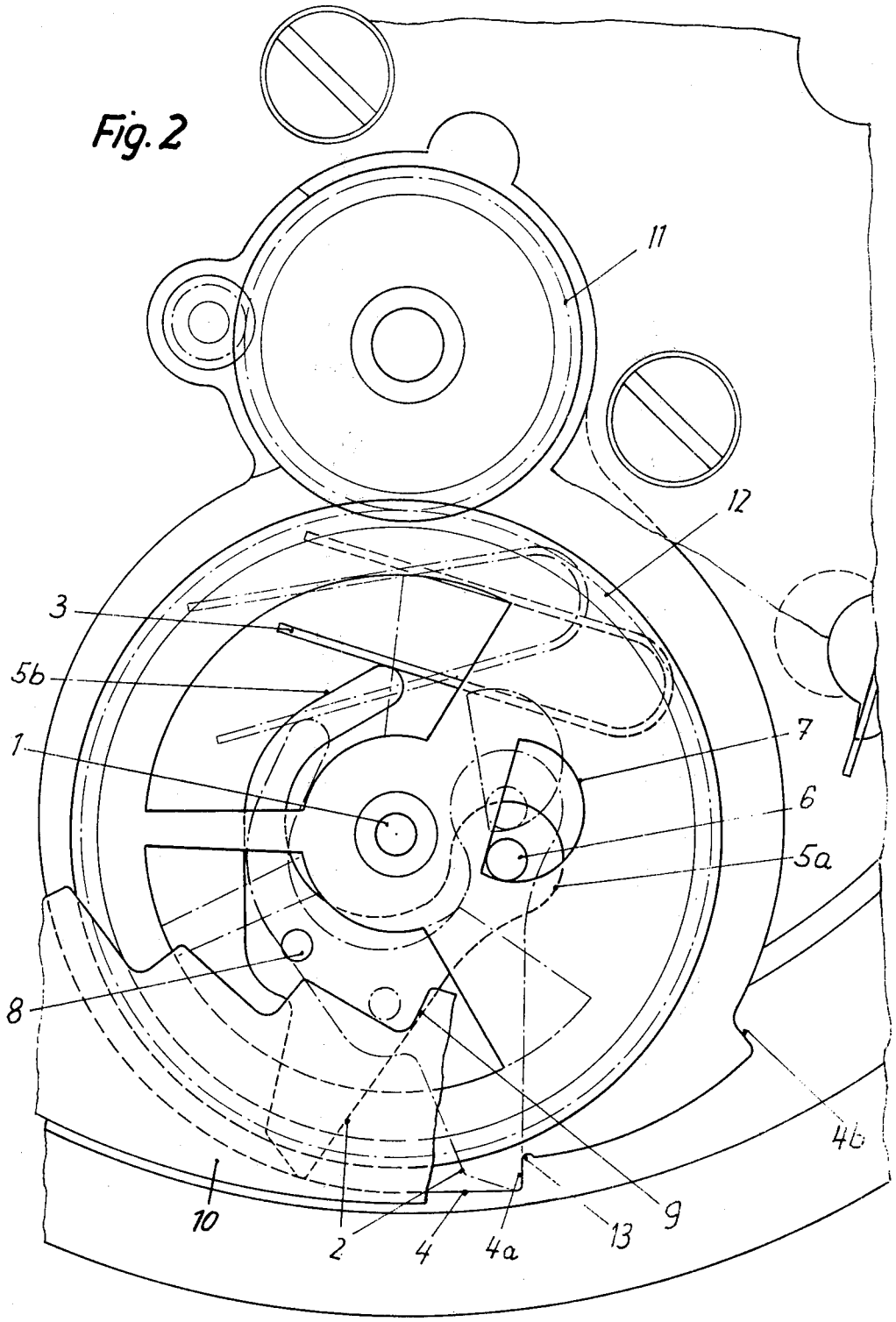

In the embodiment shown in FIGS. 1 and 2, the stepping mechanism comprises a date-stepping finger 2, which is mounted for rotation on an axis defined by a pin 1 and is radially movable relative to said axis. A U-shaped spring 3 urges the date-stepping finger into a stationary peripheral series of teeth 4. The date-stepping finger 2 has a forked end portion, which comprises a first prong 5*a*, which carries a pin 6, which extends into an apertured one-way coupling element 7, which forms part of a rotary disc 12 driven by an hour wheel 11 and performing one revolution per day. The forked end portion of the date-stepping finger 2 comprises a second prong 5*b*, which bears on the spring 3. The date-stepping finger 2 carries a stepping pin 8, which is arranged to engage a series of teeth 9 of a date ring 10 during the date-stepping movement. To initiate the date-stepping movement the eccentric pin 6 extending through the apertured portion 7 of the rotary disc 12 is caused by the rotation of the disc 12 to withdraw the date-stepping finger 2 from the series of teeth 4 so that the spring 3 causes the date-stepping finger 2 to perform a jump and to impart by its stepping pin 8 a date-stepping movement to the date ring 10. The stepping pin 8 prevents a double jump. The series of teeth 4 engageable by the date-stepping finger consists of first and second teeth, which are peripherally spaced. The date-stepping finger 2 engages the first tooth 4*a* before the date-stepping movement, which is initiated in that the date-stepping finger 2 is withdrawn from the first tooth 4*a*, and is terminated in that the date-stepping finger 2 engages the second tooth 4*b*. This date-stepping movement is performed when the hour wheel 11 driving the rotary disc 12 is assuming the position for 0 hours. After the date-stepping finger 2 has performed its date-stepping movement, the one-way coupling element 7 withdraws the date-stepping finger 2 from the second tooth 4*b* and the rotary disc 12 then imparts to the date-stepping finger 2 a continued rotary movement until the date-stepping finger re-engages the first tooth 4*a* under the action of the spring 3. The series of teeth 9 are arranged to be clear of the stepping pin 8 of the date-stepping finger 2 during said continued rotary movement thereof. For this purpose, and to permit of the use of a date-shipping mechanism which is small in relation to the diameter of the date-ring 10, the rotary disc 12 is eccentric with respect to the date ring 10. The first tooth 4*a* is formed with a hump 13, which protrudes radially inwardly from the date ring 10 so that the date-stepping finger 2 is clear of the date ring 10 during the date-stepping movement.

The date-stepping finger 2 and the U-shaped spring 3 are mounted on the rotary disc 12, which is driven by the hour wheel 11. A portion of the disc 12 consists of the apertured one-way coupling element 7, which receives the pin 6 for a one-way coupling engagement. The rotary disc 12 is formed with an upstanding rim, which is formed with a slot 14, through which the date-stepping finger 6 extends. This arrangement permits of a setting of all indications of the watch in forward and reverse directions by the winding and setting shaft.

Figure 3:
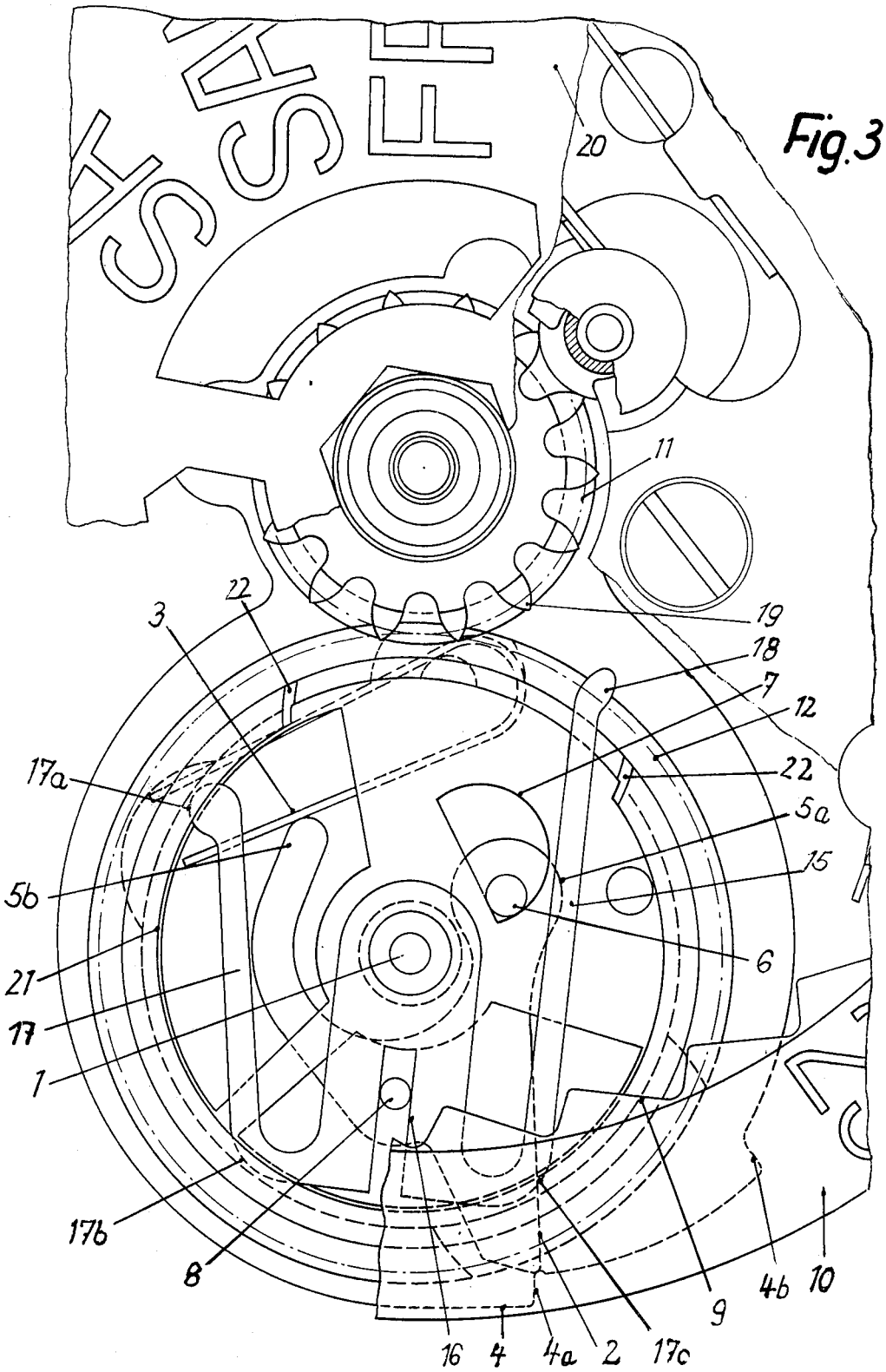
FIGS. 3 and 4 are top plan views showing a date- and day-stepping mechanism before and after the stepping movement, respectively.
Figure 4:
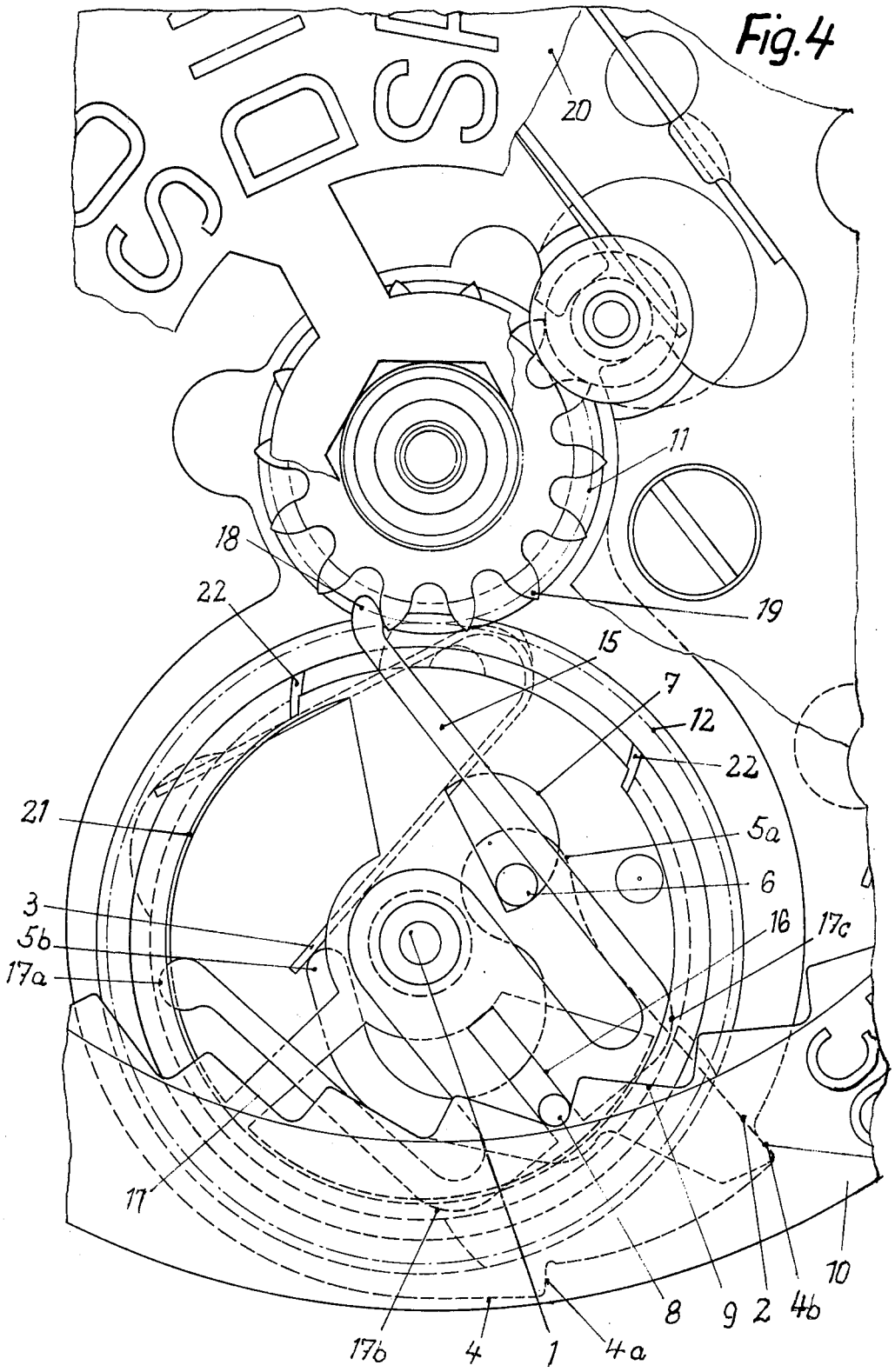

In the embodiment shown in FIGS. 3 and 4, a day-stepping finger 15 is associated with the date-stepping finger 2 and mounted for rotation on the pin 1. The stepping movement of the date-stepping finger 2 is imparted to the day-stepping finger 15 by the stepping pin 8, which extends through a slot 16 of the day-stepping finger 15. The day-stepping finger 15 is W-shaped and comprises a spring limb 17 and a stepping limb 18, which is engageable with a day-stepping gear 19. The day-stepping finger 15 is rotatably mounted between the limbs 17 and 18. The stepping limb 18 is provided at its outer end with a stepping tooth for stepping the day-stepping gear 19. The day-stepping finger 15 may be arranged to impart to the day-stepping gear 19 a stepping movement which corresponds to a single tooth pitch or a plurality of tooth pitches, so that the day-indicating disc 20 may bear indications of the days of the week in one language or in two or more languages, as is shown on the drawing. The day-stepping finger 15 rests on the date-stepping finger 2 so that both fingers are supported by the rotary disc 12. The spring limb 17 of the W-shaped day-stepping finger has outer and inner end portions 17*a* and 17*b*, respectively, and the stepping limb 18 of the finger 15 has an inner end portion 17*c*. These limb end portions 17*a*, 17*b*, and 17*c* extend into a recess formed on the inside of the upstanding rim 21 of the rotary disc 12. The stepping tooth at the outer end of the stepping limb 18 extends through an aperture 22 of the upstanding rim 21 of the rotary disc 12.

The stepping limb 18 of the W-shaped day-stepping finger 15 cooperates with the pin 8 to limit the stepping movement of the day-stepping gear 19 and day-indicating disc 20, as is apparent from FIG. 4. Because the stepping limb 18 of the day-stepping finger 15 is resilient and the date-stepping finger 2 is in yieldable engagement, the mechanism will not block a change of the indication of the watch.

Figure 5:
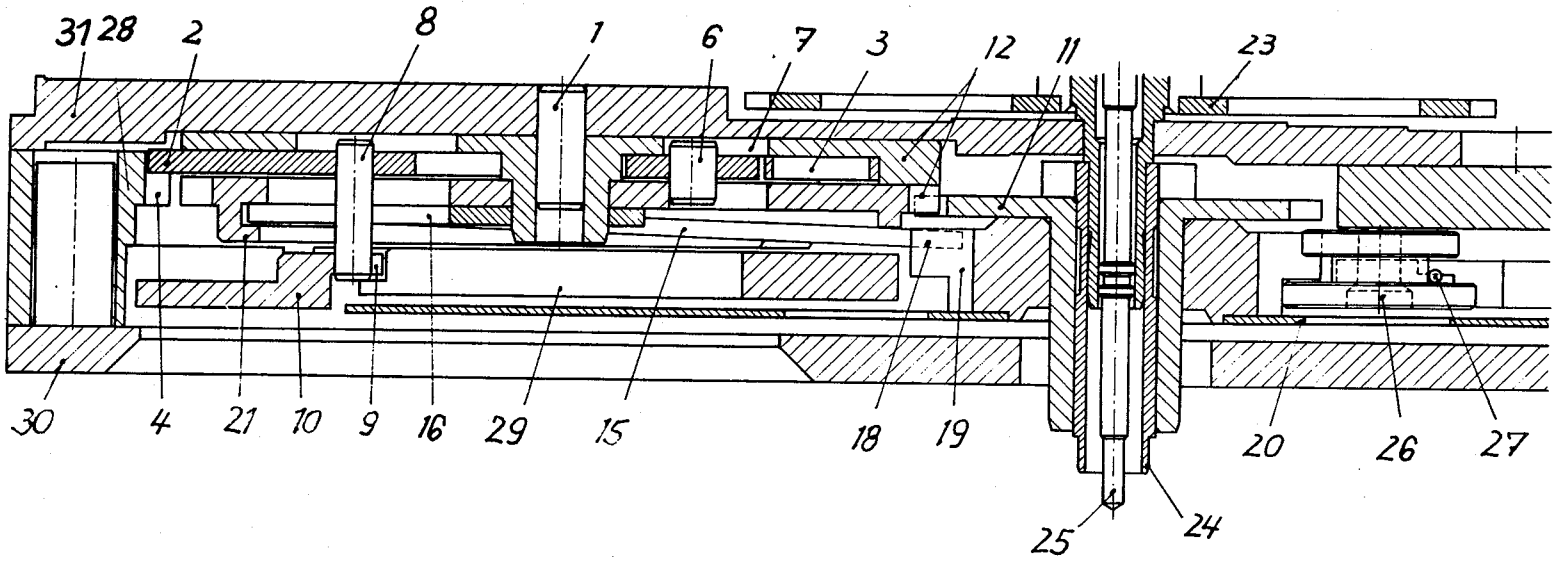
FIG. 5 is a transverse sectional view showing a stepping mechanism of the type described hereinbefore.

FIG. 5 shows the hour wheel 11, a minute wheel 23 provided with a cannon 23, a central seconds arbor 25, a click 26 cooperating with the day-stepping gear 19, a spring 27, which biases the click, a calendar plate 28, a date ring-carrying plate 29 and a dial 30. The retaining plate 31 is also apparent.

What is claimed is:

1. In a watch having a rotatably mounted date ring, the provision of a date-stepping mechanism for advancing said date ring, said mechanism comprising a stationary peripheral first series of teeth, a rotary drive element, a date-stepping finger, which is mounted to be rotatable and radially displaceable relative to said rotary drive element into and out of engagement with said first series of teeth and comprises a stepping pin, a forked end portion having first and second prongs, and a drive pin carried by said first prong, a one-way coupling element, which is in one-way coupling engagement with said drive pin and is eccentric with respect to and arranged to revolve with said rotary drive element in a predetermined direction of revolution and to repeatedly withdraw said date-stepping finger from said first series of teeth after respective intervals of time, and spring means engaging said second prong and urging said date-stepping finger radially outwardly and in said predetermined direction of revolution, said spring means being adapted to impart a rotary stepping movement to said date-stepping finger in said predetermined direction of revolution and into engagement with said first series of teeth when said date-stepping finger has thus been withdrawn from said first series of teeth, said mechanism also comprising a second series of teeth, which are carried by said date ring and arranged to be engaged by said stepping pin during said rotary stepping movement of said date-stepping finger.

2. A stepping mechanism as set forth in claim 1, in which said spring means comprise a U-shaped spring.

3. A stepping mechanism as set forth in claim 1, in which said rotary drive element is arranged to perform one revolution per day, said first series of teeth comprise a first tooth and a second tooth, which is peripherally spaced from said first tooth, said spring means are arranged to impart said rotary stepping movement to said date-stepping finger in said predetermined direction of revolution and into engagement with said second tooth when said date-stepping finger has thus been withdrawn from said first tooth, said one-way coupling element is arranged to withdraw said date-stepping finger from said second tooth after said rotary stepping movement of said date-stepping finger, and said rotary drive element is arranged to impart to said date-stepping finger a continued rotary movement in said predetermined direction of revolution when said date-stepping finger has thus been withdrawn from said second tooth and until said date-stepping finger reengages said first tooth under the action of said spring means, said second series of teeth are arranged to be clear of said stepping pin during continued rotary movement of said date-stepping finger.

4. A date-stepping mechanism as set forth in claim 3, in which said first series of teeth define between said first and second teeth a surface which is recessed from said first tooth to clear said date-stepping finger throughout its said rotary stepping movement.

5. A date-stepping mechanism as set forth in claim 4, in which said first tooth is formed with a hump, which protrudes radially inwardly from said surface.

6. A date-stepping mechanism as set forth in claim 1, in a watch which comprises a hour wheel, in which mechanism said rotary drive element comprises a rotary disc, which is arranged to be rotated by said hour wheel and has an upstanding rim formed with a peripheral slot, said one-way coupling element consists of an apertured eccentric portion of said rotary disc, said date-stepping finger and said spring means are supported by and in frictional contact with said rotary disc, said drive pin extends through said apertured eccentric portion, and said stepping finger extends through said peripheral slot.

7. A date-stepping mechanism as set forth in claim 3, in which said rotary drive element is eccentric to said date ring.

8. A date-stepping mechanism as set forth in claim 1, in a watch comprising day-indicating means for indicating the day of the week, in which mechanism a day-stepping finger is mounted to be rotatable relative to said central drive element and formed with a slot, and said stepping pin extends through said slot and is adapted to rotate said day-stepping finger in unison with said date-stepping finger.

9. A date-stepping mechanism as set forth in claim 8 in which said day-stepping finger is W-shaped and comprises a spring limb, a stepping limb and an intermediate portion between said limbs, and a day-stepping gear is provided, which is engageable by said stepping limb and operatively connected to said day-indicating means.

10. A date-stepping mechanism as set forth in claim 9, in which said stepping limb is resilient and provided at its outer end with a stepping tooth in yieldable engagement with said day-stepping gear to permit of a setting of the watch without interlocking.

11. A stepping mechanism as set forth in claim 9 in which said rotary drive element consists of a rotary disc, which has an upstanding rim formed with a peripheral slot and formed in its inside surface with a peripheral recess, said first limb has inner and outer end portions extending into said recess, and said second limb has an inner end portion extending into said recess and an outer end portion extending through said peripheral slot.

12. A stepping mechanism as set forth in claim 8, in which said rotary drive element consists of a rotary disc, said one-way coupling element consists of an apertured eccentric portion of said rotary disc, said date-stepping finger and said spring means are supported by and in frictional contact with said rotary disc, said drive pin extends through said apertured eccentric portion, and said date-stepping finger is supported by said date-stepping finger on said rotary disc.

13. In a watch having an indicating ring, the provision of a stepping mechanism for advancing said indicating ring, said mechanism comprising a rotary drive element which is eccentric to said indicating ring, a stationary peripheral series of teeth which are disposed adjacent to said indicating ring and comprise a first tooth and a second tooth, which is peripherally spaced from said first tooth, a date-stepping finger, which is mounted to be rotatable and radially displaceable relative to said rotary drive element into and out of engagement with said first series of teeth and comprises a stepping pin, a forked end portion having first and second prongs, and a drive pin carried by said first prong.

a one-way coupling element, which is in one-way coupling engagement with said drive pin and is eccentric with respect to said rotary drive element and arranged to revolve with the same in a predetermined direction of revolution and to repeatedly withdraw said stepping finger from said first tooth after respective intervals of time and subsequently from said second tooth, and spring means engaging said second prong and urging said stepping finger radially outwardly and in said predetermined direction of revolution, said spring means being arranged to impart a rotary stepping movement to said date-stepping finger in said predetermined direction of revolution and into engagement with said second tooth when said stepping finger has thus been withdrawn from said first tooth, said mechanism further comprising a second series of teeth, which are carried by said indicating ring and arranged to be engaged by said stepping pin during its said rotary movement, said rotary drive element being arranged to impart to said date-stepping finger a continued rotary movement in said predetermined direction of revolution when said stepping finger has thus been withdrawn from said second tooth and until said stepping finger reengages said first tooth under the action of said spring means, said second series of teeth being arranged to be clear of said stepping pin during said continued rotary movement of said stepping finger.

* * * * *